US006628057B2

(12) United States Patent
Thaler et al.

(10) Patent No.: US 6,628,057 B2
(45) Date of Patent: Sep. 30, 2003

(54) SLIGHTLY CONDUCTING INSULATORS FOR CATHODE-RAY TUBE (CRT) APPLICATIONS

(75) Inventors: Barry Jay Thaler, Lawrenceville, NJ (US); Philip Michael Heyman, West Windsor, NJ (US); Robert Leon Quinn, Trenton, NJ (US); Richard Joseph Quinn, Bordentown, NJ (US); Liyou Yang, Plainsboro, NJ (US)

(73) Assignee: Thomson Licensing S. A., Boulogne Cedex (FR)

( * ) Notice: Subject to any disclaimer, the term of this patent is extended or adjusted under 35 U.S.C. 154(b) by 0 days.

(21) Appl. No.: 09/745,784

(22) Filed: Dec. 22, 2000

(65) Prior Publication Data

US 2002/0079811 A1 Jun. 27, 2002

(51) Int. Cl.[7] ..... H01J 29/80
(52) U.S. Cl. ..... 313/407; 313/402; 313/408
(58) Field of Search ..... 313/402, 403, 313/404, 405, 406, 407, 408, 409, 414

(56) References Cited

U.S. PATENT DOCUMENTS 5,647,653 A * 7/1997 Cherukuri ..... 313/402

* cited by examiner

*Primary Examiner*—Vip Patel
*Assistant Examiner*—Joseph Williams
(74) *Attorney, Agent, or Firm*—Joseph S. Tripoli; Joseph J. Laks; Carlos M. Herrera

(57) ABSTRACT

A color cathode-ray tube (CRT) has an evacuated envelope with an electron gun therein for generating an electron beam. The envelope further includes a faceplate panel having a luminescent screen with phosphor elements on an interior surface thereof. A focus mask, having a plurality of spaced-apart first conductive strands, is located adjacent to an effective picture area of the screen. The spacing between the first conductive strands defines a plurality of apertures substantially parallel to the phosphor elements on the screen. Each of the first conductive strands has a substantially continuous slightly conductive insulating material layer formed on a screen facing side thereof. A plurality of second conductive wires are oriented substantially perpendicular to the plurality of first conductive strands and are bonded thereto by the slightly conductive insulating material layer. The slightly conductive insulating material layer is a composite material comprising one or more transition metal oxides and a lead-zinc-borosilicate glass.

8 Claims, 4 Drawing Sheets

SLIGHTLY CONDUCTING INSULATORS FOR CATHODE-RAY TUBE (CRT) APPLICATIONS

BACKGROUND OF THE INVENTION

1. Field of the Invention

This invention relates to a color cathode-ray tube (CRT) and, more particularly to a color CRT including a focus mask.

2. Description of the Background Art

A color cathode-ray tube (CRT) typically includes an electron gun, an aperture mask, and a screen. The aperture mask is interposed between the electron gun and the screen. The screen is located on an inner surface of a faceplate of the CRT tube. The screen has an array of three different color-emitting phosphors (e.g., green, blue, red) formed thereon. The apertured mask functions to direct electron beams generated in the electron gun toward appropriate color emitting phosphors on the screen of the CRT tube.

The aperture mask may be a focus mask. Focus masks typically comprise two sets of conductive lines (or wires) that are arranged approximately orthogonal to each other, to form an array of openings. Different voltages are applied to the two sets of conductive lines so as to create a multipole focusing lens in each opening of the mask. The multipole focusing lenses are used to direct the electron beams toward the color-emitting phosphors on the screen of the CRT tube.

One type of focus mask is a tensioned focus mask, wherein at least one of the two sets of conductive lines is under tension. Typically, for tensioned focus masks, the vertical set of conductive lines is under tension, with the horizontal set of conductive lines overlying such vertical tensioned lines.

Where the two sets of conductive lines overlap, such conductive lines are typically attached at their crossing points (junctions) by an insulating material. When different voltages are applied between the two sets of conductive lines of the mask, to create the multipole focusing lenses in the openings thereof, high voltage (HV) flashover may occur at one or more junctions. HV flashover is the discharge of an electrical charge across the insulating material separating the two sets of conductive lines. HV flashover is undesirable because it may cause an electrical short circuit between the two sets of conductive lines, leading to the subsequent failure of the focus mask.

Also, when the electron beams from the electron gun are directed toward the color emitting phosphors on the screen, backscattered electrons from the screen may cause the insulator material on the focus mask to charge. Such charging is undesirable because it may interfere with the ability of the focus mask to direct the electron beams toward the color emitting phosphors formed on the screen, as well as cause HV flashover between the conductive lines of the focus mask.

Thus, a need exists for suitable insulating materials that overcome the above-mentioned drawbacks.

SUMMARY OF THE INVENTION

The present invention relates to a color cathode-ray tube (CRT) having an evacuated envelope with an electron gun therein for generating an electron beam. The envelope further includes a faceplate panel having a luminescent screen with phosphor elements on an interior surface thereof. A focus mask, having a plurality of spaced-apart first conductive strands, is located adjacent to an effective picture area of the screen. The spacing between the first conductive strands defines a plurality of apertures substantially parallel to the phosphor elements on the screen. Each of the first conductive strands has a substantially continuous slightly conductive insulating material layer formed on a screen facing side thereof. A plurality of second conductive wires are oriented substantially perpendicular to the plurality of first conductive strands and are bonded thereto by the slightly conductive insulating material layer. The slightly conductive insulating material layer is a composite material comprising one or more transition metal oxides and a lead-zinc-borosilicate glass.

BRIEF DESCRIPTION OF THE DRAWING

The invention will now be described in greater detail, with relation to the accompanying drawing, in which.

DETAILED DESCRIPTION OF THE PREFERRED EMBODIMENT

Figure 1:
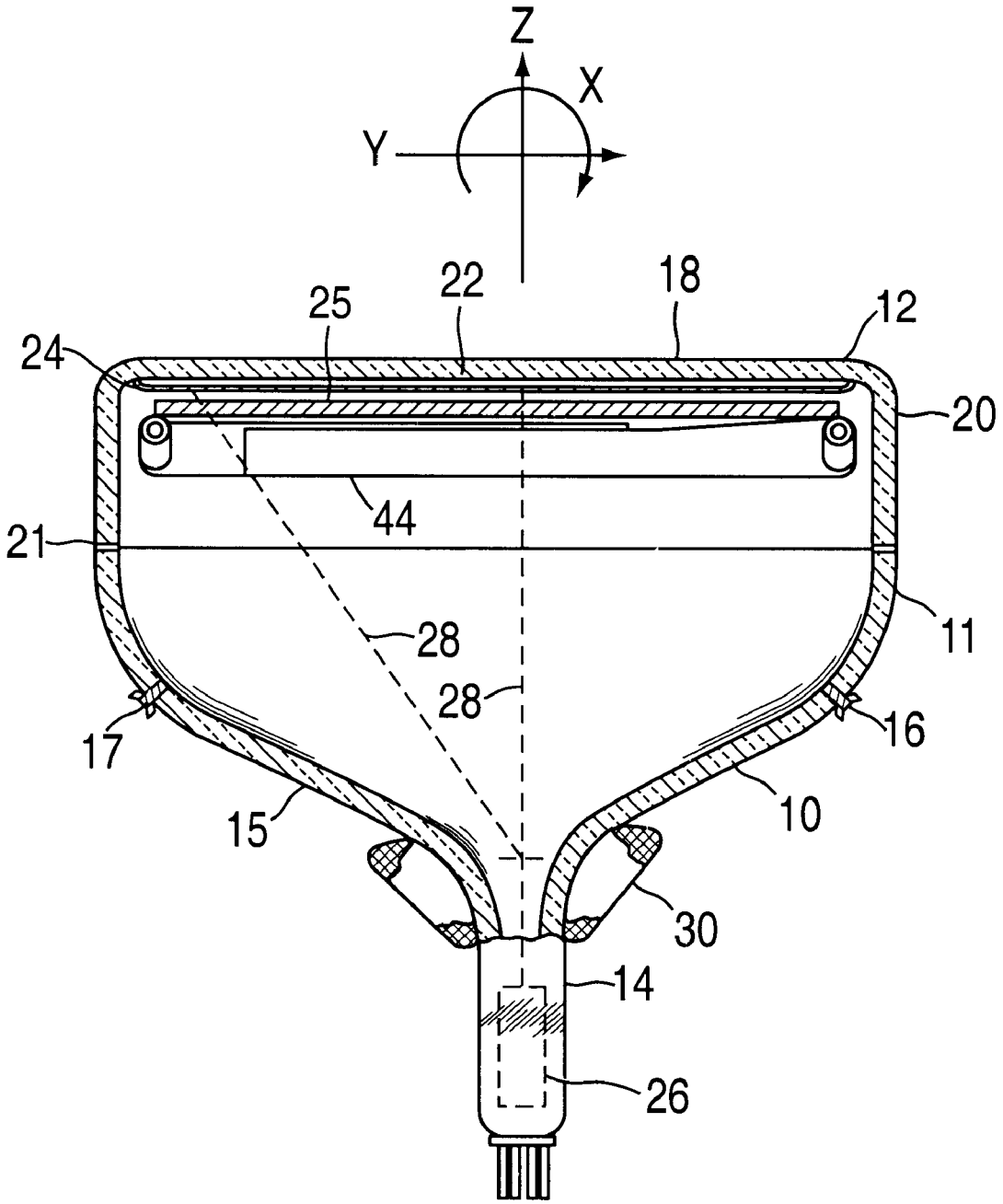
FIG. 1 is a plan view, partly in axial section, of a color cathode-ray tube (CRT) including a focus mask-frame assembly embodying the present invention.

FIG. 1 shows a color cathode-ray tube (CRT) 10 having a glass envelope 11 comprising a faceplate panel 12 and a tubular neck 14 connected by a funnel 15. The funnel 15 has an internal conductive coating (not shown) that is in contact with, and extends from, a first anode button 16 to the neck 14. A second anode button 17, located opposite the first anode button 16, is not contacted by the conductive coating.

The faceplate panel 12 comprises a viewing faceplate 18 and a peripheral sidewall 20, or skirt, that is sealed to the funnel 15 by a glass frit 21. A three-color luminescent phosphor screen 22 is coated on the inner surface of the faceplate 18. The screen 22 is a line screen, shown in detail in FIG. 5, that includes a multiplicity of screen elements comprising red-emitting, green-emitting, and blue-emitting phosphor elements, R, G, and B, respectively, arranged in triads, each triad including a phosphor line of each of the three colors. Preferably, a light absorbing matrix 23 separates the phosphor elements. A thin conductive layer 24, preferably made of aluminum, overlies the screen 22 and provides means for applying a uniform first anode potential to the screen as well as for reflecting light, emitted from the phosphor elements, through the faceplate 18.

A cylindrically curved multi-aperture color selection electrode, or focus mask 25, is mounted, by conventional means, within the faceplate panel 12, in predetermined spaced relation to the screen 22. An electron gun 26, shown schematically by the dashed lines in FIG. 1, is centrally mounted within the neck 14 to generate and direct three inline electron beams 28, a center and two side or outer beams, along convergent paths through the focus mask 25 to the screen 22. The inline direction of the center beam 28 is approximately normal to the plane of the paper.

The CRT of FIG. 1 is designed to be used with an external magnetic deflection yoke, such as the yoke 30, shown in the neighborhood of the funnel-to-neck junction. When activated, the yoke 30 subjects the three electron beams to magnetic fields that cause the beams to horizontally and vertically scan a rectangular raster across the screen 22.

The focus mask 25 comprises two electrodes, one of which is formed, preferably, from a thin rectangular sheet of about 0.05 mm (2 mil) thick low carbon steel (about 0.005 % carbon by weight). Suitable materials may include high expansion, low carbon steels having a coefficient of thermal expansion (CTE) within a range of about $120–160\times10^{-7}$ /° C.; intermediate expansion alloys such as, iron-cobalt-nickel (e.g., KOVAR™) having a coefficient of thermal expansion within a range of about $40–60\times10^{-7}$/° C.; as well as low expansion alloys such as, iron-nickel (e.g., INVAR™) having a coefficient of thermal expansion within a range of about $9–30\times10^{-7}$/° C.

Figure 2:
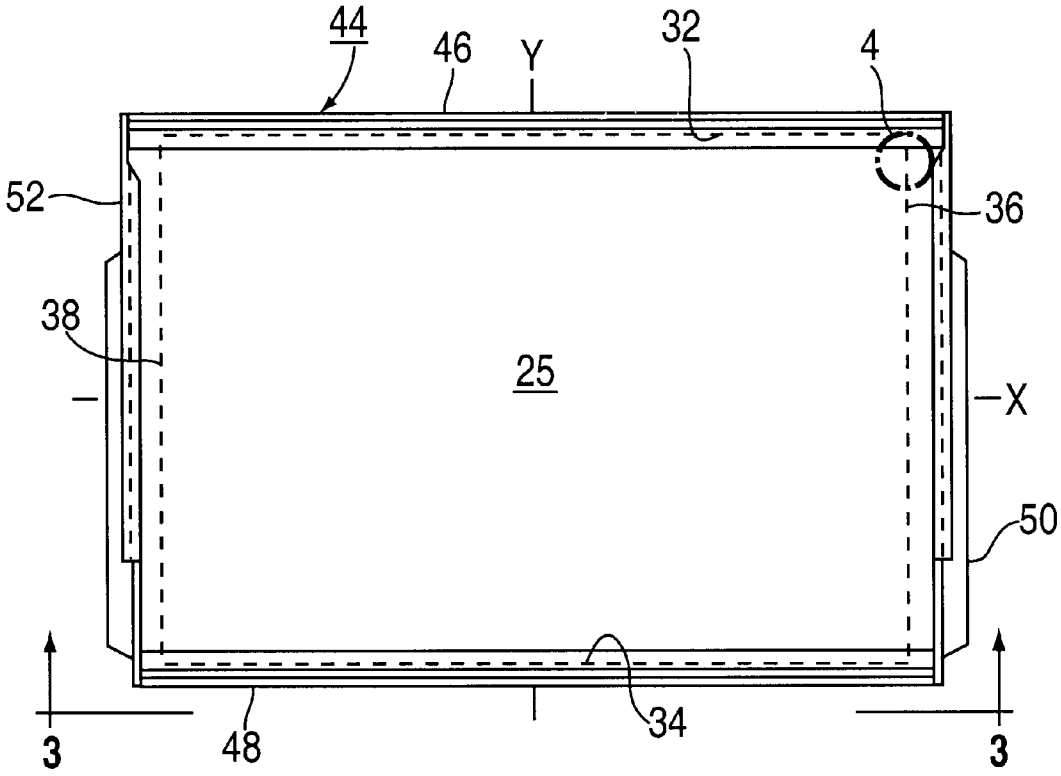
FIG. 2 is a plan view of the focus mask-frame assembly of FIG. 1.

As shown in FIG. 2, the focus mask 25 includes two horizontal sides 32, 34 and two vertical sides 36, 38. The two horizontal sides 32, 34 of the focus mask 25 are parallel with the central major axis, X, of the CRT while the two vertical sides 36, 38 are parallel with the central minor axis, Y, of the CRT.

Figure 4:
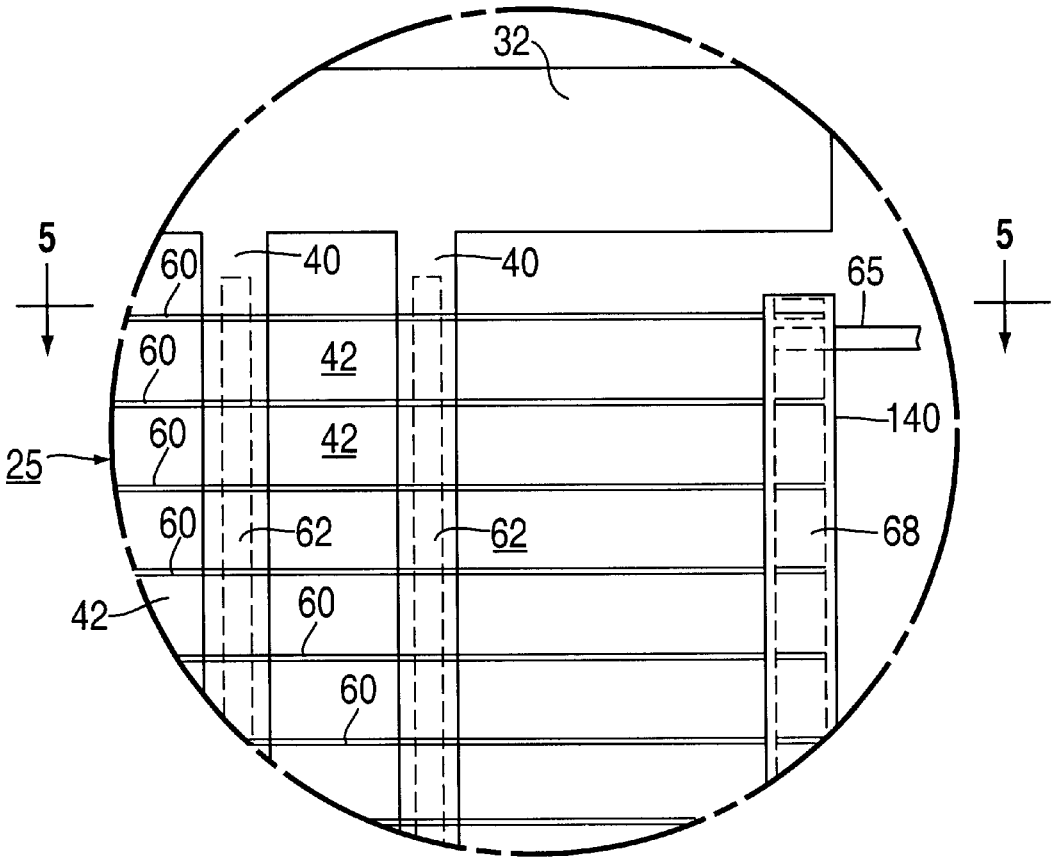
FIG. 4 is an enlarged section of the focus mask shown within the circle 4 of FIG. 2.

The focus mask 25 (shown schematically by the dashed lines in FIG. 2) includes an apertured portion that is adjacent to and overlies an effective picture area of the screen 22. Referring to FIG. 4, the focus mask 25 includes a plurality of first metal strands 40 (conductive lines), each having a transverse dimension, or width, of about 0.3 mm to about 0.5 mm (12–20 mils) separated by spaced apertures 42, each having a width of about 0.27 mm to about 0.43 mm (11–16 mils) that parallel the minor axis, Y, of the CRT and the phosphor elements of the screen 22. For a color CRT having a diagonal dimension of 68 cm, the first metal strands have widths in a range of about 0.30 mm to about 0.38 mm (12–14.5 mils) and aperture widths of about 0.27 mm to about 0.33 mm (11–13.3 mils). In a color CRT having a diagonal dimension of 68 cm (27 V), there are about 760 of the first metal strands 40. Each of the apertures 42 extends from one horizontal side 32 of the mask to the other horizontal side 34 thereof (not shown in FIG. 4).

Figure 3:
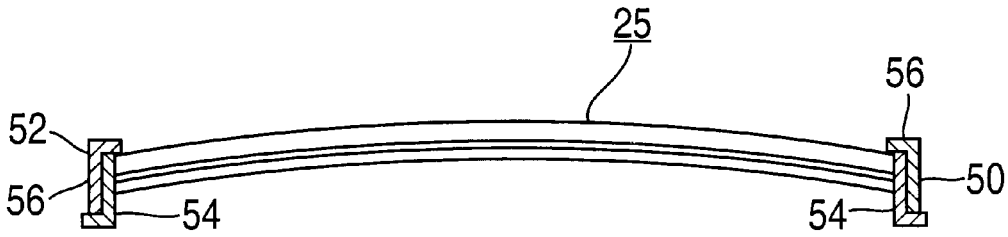
FIG. 3 is a front view of the mask-frame assembly taken along line 3—3 of FIG. 2.

A frame 44, for the focus mask 25, is shown in FIGS. 1–3, and includes four major members, two torsion tubes or curved members 46, 48 and two tension arms or straight members 50, 52. The two curved members 46, 48 are parallel to the major axis, X, and each other.

As shown in FIG. 3, each of the straight members 50, 52 includes two overlapped partial members or parts 54, 56, each part having an L-shaped cross-section. The overlapped parts 54, 56 are welded together where they are overlapped. An end of each of the parts 54, 56 is attached to an end of one of the curved members 46, 48. The curvature of the curved members 46, 48 matches the cylindrical curvature of the focus mask 25. The horizontal sides 32, 34 of the focus mask 25 are welded between the two curved members 46, 48, which provides the necessary tension to the mask. Before welding the horizontal sides 32, 34 of the focus mask 25 to the frame 44, the mask material is pre-stressed and blackened by tensioning the mask material while heating it, in a controlled atmosphere of nitrogen and oxygen, at a temperature of about 500° C., for about 120 minutes. The frame 44 and the mask material, when welded together, comprise a mask assembly.

Figure 5:
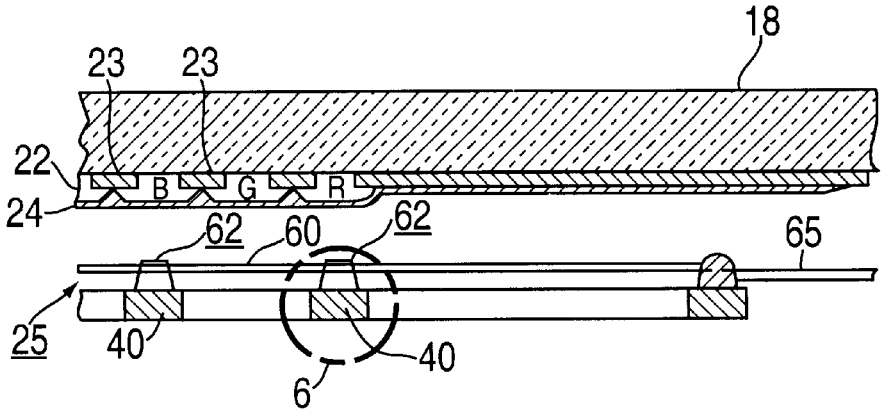
FIG. 5 is a view of the focus mask and the luminescent screen taken along lines 5—5 of FIG. 4.

With reference to FIGS. 4 and 5, a plurality of second metal wires 60, each having a diameter of about 0.025 mm (1 mil), are disposed substantially perpendicular to the first metal strands 40 and are spaced therefrom by a slightly conductive insulator 62, formed on the screen-facing side of each of the first metal strands 40. The second metal wires 60 form cross members that facilitate the application of a potential to the focus mask 25. Suitable materials for the second metal wires include iron-nickel alloys such as INVAR™ and/or carbon steels such as HyMu80 wire (commercially available from Carpenter Technology, Reading, Pa.).

The vertical spacing, or pitch, between adjacent second metal wires 60 is about 0.33 mm (13 mils) for a color CRT having a diagonal dimension of 68 cm (27 V). The relatively thin second metal wires 60 (as compared to the first metal strands 40) provide the essential focussing function of the focus mask 25, without adversely affecting the electron beam transmission thereof. The focus mask 25, described herein, provides a mask transmission, at the center of the screen 22, of about 40–45 %, and requires that the second anode, or focussing, voltage, •V, applied to the second metal wires 60, differs from the first anode voltage applied to the first metal strands 40 by less than about 1 kV, for a first anode voltage of about 30 kV.

The slightly conductive insulators 62, shown in FIG. 4, are disposed substantially continuously on the screen-facing side of each of the first metal strands 40. The second metal wires 60 are bonded to the slightly conductive insulators 62 to electrically isolate the second metal wires 60 from the first metal strands 40.

The slightly conductive insulators 62 are formed of a suitable material that has a thermal expansion coefficient that is matched to the material of the focus mask 25. The material of the slightly conductive insulators should preferably have a relatively low melting temperature so that it may flow, harden, and adhere to both the first and second metal strands 40, 60 within a temperature range of about 450 ° C. to about 500° C. The slightly conductive insulator material should also preferably have a dielectric breakdown strength of about 40000 V/mm (1000 V/mil), with bulk and surface electrical resistivities of about $10^{11}$ ohm-cm and $10^{12}$ ohm/square, respectively. Additionally, the slightly conductive insulator material should be stable at temperatures used for sealing the CRT faceplate panel 12 to the funnel (temperatures of about 450° C. to about 500 ° C.), as well as having adequate mechanical strength and elastic modulus, and be low outgassing during processing and operation for an extended period of time under electron beam bombardment.

The slightly conductive insulators 62 are formed of a composite material comprising one or more transition metal oxides and a lead zinc borosilicate glass. The one or more transition metal oxides can either be melted with the lead zinc borosilicate glass or mixed together with a lead zinc borosilicate glass powder. The addition of the one or more transition metal oxides to the lead zinc borosilicate glass increases the electrical conductivity of the borosilicate glass, such that it does not accumulate charge when bombarded by an electron beam.

The weight percent of the one or more transition metal oxides in the composite material is used to control the electrical conductivity of the insulator material. The weight percent of the one or more transition metal oxides in the composite material is preferably within a range of about 2% by weight to about 12% by weight.

Suitable lead zinc borosilicate glasses include SCC-11, commercially available from SEM-COM, Toledo, Ohio.

Suitable transition metal oxides include iron oxide ($Fe_2O_3$ and $Fe_3O_4$), molybdenum oxide ($MoO_3$), titanium oxide ($TiO_2$), zinc oxide (ZnO), chromium oxide ($Cr_2O_3$), nickel oxide (NiO), and tin oxide ($SnO_2$), among others.

Figure 6:
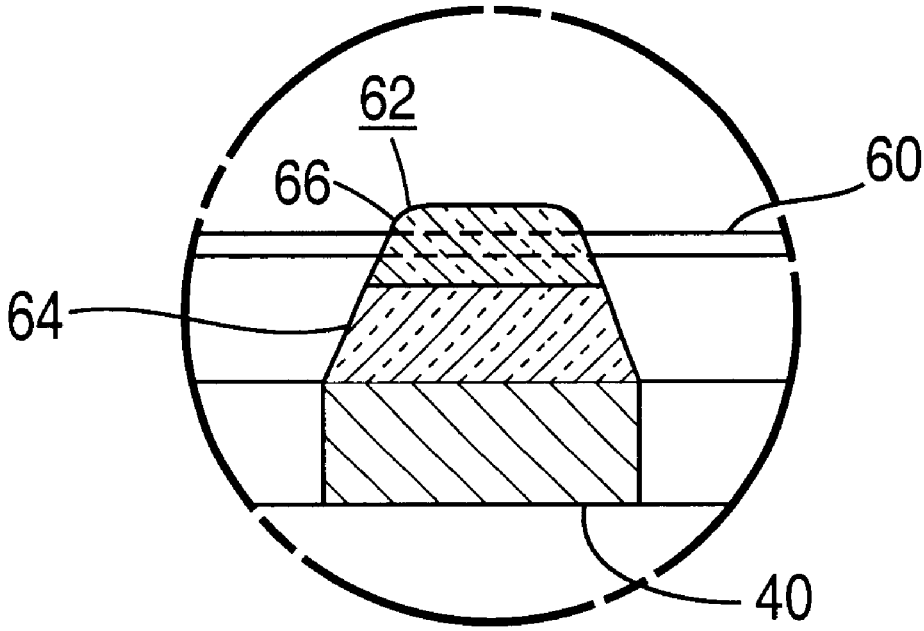
FIG. 6 is an enlarged view of a portion of the focus mask shown within the circle 6 of FIG. 5.

According to a preferred method of making the focus mask 25, and referring to FIG. 6, a first coating of the slightly conductive insulator 64 is provided, e.g., by spraying, onto the screen-facing side of the first metal strands 40. The first metal strands 40, in this example, are formed of flat tension mask steel (FTM), having a coefficient of thermal expansion within the range of $110–150\times10^{-7}/°$ C. The first insulator coating, for example, may be a lead-zinc borosilicate glass such as SCC-11 comprising about 7% by weight $Fe_2O_3$, premelted with the SCC-11 glass powder. The premelted SCC-11 glass powder is mixed with a binder as well as solvents to form a slurry suitable for spraying onto the first metal strands 40. The first coating of the insulator typically has a thickness of about 0.05 mm to about 0.09 mm (2–3.5 mils).

The frame 44, including the coated first metal strands 40, is dried at room temperature. After drying, the first coating of the slightly conductive insulator material 64 is hardened (sintered) by heating the frame 44 and the first metal strands 40, in an oven. The frame 44 is heated over a period of about 30 minutes to a temperature of about 300° C., and held at 300° C., for about 20 minutes. Then over a period of about 20 minutes the temperature of the oven is increased to about 460° C., and held at that temperature for one hour to melt and crystallize the first coating of the slightly conductive insulator material 64 on the first metal strands 40. The first coating of the slightly conductive insulator material 64, after crystallization, will typically not remelt at normal process temperatures. The first coating of the slightly conductive insulator material 64 is typically dome-shaped and has a thickness within a range of about 0.05 mm to about 0.09 mm (2–3.5 mils) across each of the strands 40.

After the first coating of the slightly conductive insulator material 64 is fired, a second coating of slightly conductive insulator material 66 is applied over the first coating of the slightly conductive insulator material 64. The second coating of slightly conductive insulator material 66 may have the same composition as the first coating. The second coating of the slightly conductive insulator material 66 has a thickness of about 0.005 mm to about 0.025 mm (0.21–1 mils).

Thereafter, the second metal wires 60 are applied to the frame 44, over the second coating of the slightly conductive insulator material 66, such that the second metal wires 60 are substantially perpendicular to the first metal strands 40. The second metal wires 60 are applied using a winding fixture (not shown) that accurately maintains a desired spacing of for example, about 0.33 mm (13 mils) between adjacent metal wires for a color CRT having a diagonal dimension of about 68 cm (27 V).

The frame 44, including the winding fixture, is heated to a temperature of about 460° C. for about 120 minutes to bond the second metal wires 60 to the second coating of the slightly conductive insulator material 66. After the second coating is sintered, the frame 44 is taken out of the holding device, electrical connections are made to the first and second strands 40, 60, and the focus mask 25 is inserted into a tube envelope.

What is claimed is:

1. A cathode-ray tube comprising an evacuated envelope having therein an electron gun for generating an electron beam, a faceplate panel having a luminescent screen with phosphor elements on an interior surface thereof, and a focus mask, wherein the focus mask includes a plurality of spaced-apart first conductive strands having a slightly insulating material thereon, and a plurality of spaced-apart second conductive wires oriented substantially perpendicular to the plurality of spaced-apart first conductive strands, the plurality of spaced-apart second conductive wires being bonded to a slightly conductive insulating material, wherein the slightly conductive insulating material is composed of a composite material comprising one or more transition metal oxides and a lead-zinc-borosilicate glass, wherein the one or more transition metal oxides are selected from the group consisting of iron oxide ($Fe_2O_3$ and $Fe_3O_4$), titanium dioxide ($TiO_2$), zinc oxide (ZnO), molybdenum oxide ($MoO_3$), chromium oxide ($Cr_2O_3$), tin oxide ($SnO_2$), and nickel oxide (NiO).

2. The cathode-ray tube of claim 1 wherein the lead-zinc-borosilicate glass is SCC-11, or a mixture of lead, zinc, boron, and silicon oxides melted together to form an SCC-11-like glass.

3. The cathode-ray tube of claim 1 wherein the one or more transition metal oxides in the composite material have a weight % in a range of about 2% by weight to about 12% by weight.

4. The cathode-ray tube of claim 3 wherein the one or more transition metal oxides are added to the lead-zinc-borosilicate glass either by premelting or by mixing them with a lead-zinc-borosilicate powder.

5. A method of manufacturing a cathode-ray tube comprising an evacuated envelope having therein an electron gun for generating at least one electron beam, a faceplate panel having a luminescent screen with phosphor elements on an interior surface thereof, and a focus mask, wherein the focus mask includes a plurality of spaced-apart first conductive strands, and a plurality of spaced-apart second conductive wires oriented substantially perpendicular to the plurality of spaced-apart first conductive strands, comprising the steps of:

applying a slightly conductive insulating material to the plurality of spaced-apart first conductive strands, wherein the slightly conductive insulating material is a composite material comprising one or more transition metal oxides and a lead-zinc borosilicate glass, wherein the one or more transition metal oxides are selected from the group consisting of iron oxide ($Fe_2O_3$ and $Fe_3O_4$), titanium dioxide ($TiO_2$), zinc oxide (ZnO), molybdenum oxide ($MoO_3$), chromium oxide ($Cr_2O_3$), tin oxide ($SnO_2$), and nickel oxide (NiO); and bonding the plurality of spaced-apart second conductive wires to the slightly conductive insulating material.

6. The method of claim 5 wherein the lead-zinc-borosilicate glass is SCC-11, or a mixture of lead, zinc, boron, and silicon oxides melted together to form an SCC-11-like glass.

7. The method of claim 5 wherein the one or more transition metal oxides in the composite material have a weight % in a range of about 2% by weight to about 12% by weight.

8. The method of claim 7 wherein the one or more transition metal oxides are added to the lead-zinc-borosilicate glass either by premelting or by mixing them with a lead-zinc-borosilicate powder.

* * * * *